US011141767B2

(12) United States Patent
Rebbecchi et al.

(10) Patent No.: US 11,141,767 B2
(45) Date of Patent: Oct. 12, 2021

(54) FORGING ASSEMBLY HAVING CAPACITANCE SENSORS

(71) Applicant: UNITED TECHNOLOGIES CORPORATION, Farmington, CT (US)

(72) Inventors: Thomas A. Rebbecchi, West Hartford, CT (US); Jean Philippe Thomas, Wethersfield, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 228 days.

(21) Appl. No.: 16/049,291

(22) Filed: Jul. 30, 2018

(65) Prior Publication Data

US 2020/0030864 A1 Jan. 30, 2020

(51) Int. Cl.

| | |
|---|---|
| ***B21C 51/00*** | (2006.01) |
| ***F01D 5/14*** | (2006.01) |
| ***B21J 5/02*** | (2006.01) |
| ***B21K 3/04*** | (2006.01) |

(52) U.S. Cl.

CPC ..... *B21C 51/00* (2013.01); *B21J 5/025* (2013.01); *B21K 3/04* (2013.01); *F01D 5/147* (2013.01); *F05D 2220/32* (2013.01); *F05D 2230/25* (2013.01); *F05D 2240/30* (2013.01)

(58) Field of Classification Search

CPC .... B21C 51/00; B21J 5/025; B21J 5/02; B21J 5/00; B21J 9/20; B21K 3/04; F01D 5/147; F05D 2220/32; F05D 2230/25; F05D 2240/30; B23Q 17/00; B23Q 17/002; B23Q 17/003; B23Q 17/005; B23Q 17/006; B23Q 17/22; B21D 5/002; B30B 15/14; B30B 15/18; B30B 15/24; B30B 15/26; B30B 15/0029; B30B 15/144; B30B 15/146

USPC ..... 72/19.7, 10.1, 17.1, 17.2, 20.1, 21.1

See application file for complete search history.

(56) References Cited

U.S. PATENT DOCUMENTS 4,718,263 A * 1/1988 Crout ..... B21J 7/46 700/145
5,099,666 A * 3/1992 Sartorio ..... B21D 5/0209 72/18.1
5,661,656 A * 8/1997 Goldman ..... G05B 19/401 700/192

(Continued)

FOREIGN PATENT DOCUMENTS

JP H05348 1/1993
JP 2008036638 A * 2/2008

(Continued)

OTHER PUBLICATIONS

Translation of JP 2011161458 (Year: 2011).*

(Continued)

*Primary Examiner* — Teresa M Ekiert
*Assistant Examiner* — Teresa A Guthrie
(74) *Attorney, Agent, or Firm* — Snell & Wilmer L.L.P

(57) ABSTRACT

A forging assembly may comprise a first die and a second die configured to translate toward the second die. A first sensor may be coupled to at least one of the first die or the second die. The first sensor may be configured to output a first signal correlating to a first distance between the first die and the second die. Additional sensors may be applied to track die alignment during the forging process.

16 Claims, 4 Drawing Sheets

(56) References Cited

U.S. PATENT DOCUMENTS

| | | | | |
|---|---|---|---|---|
| 6,810,704 | B2 * | 11/2004 | Futamura | B30B 15/007 72/17.2 |
| 7,152,444 | B2 * | 12/2006 | Matsumoto | B30B 15/14 72/17.2 |
| 7,165,490 | B2 * | 1/2007 | Futamura | B30B 1/18 100/46 |
| 7,281,402 | B2 * | 10/2007 | Kirchhoff | B21C 51/00 72/16.7 |
| 8,051,709 | B2 | 11/2011 | Allen et al. | |
| 8,234,897 | B2 * | 8/2012 | Kuwayama | B21D 22/20 72/21.4 |
| 8,726,801 | B2 * | 5/2014 | Asakawa | B21D 22/00 100/43 |
| 9,899,895 | B2 | 2/2018 | Dharan | |
| 2013/0003034 | A1 * | 1/2013 | Verburg | G01D 5/24 355/67 |
| 2015/0089985 | A1 * | 4/2015 | Bereczki | B21J 1/025 72/17.3 |

FOREIGN PATENT DOCUMENTS

| | | |
|---|---|---|
| JP | 2011083790 | 4/2011 |
| JP | 2011161458 | 8/2011 |
| JP | 2011161458 A * | 8/2011 |

OTHER PUBLICATIONS

Translation of JP-2008036638-A (Year: 2008).*
Wilcoxon Sensing Technologies, "Mounting hardware and accessories," 2016 (Year: 2016).*
European Patent Office, European Search Report dated Feb. 11, 2020 in Application No. 19188131.7.
European Patent Office, European Office Action dated Jan. 25, 2021 in Application No. 19188131.7.

* cited by examiner

FORGING ASSEMBLY HAVING CAPACITANCE SENSORS

FIELD

The present disclosure relates generally to forging assemblies, and more specifically, to forging assemblies having capacitance sensors.

BACKGROUND

Precision forging is a metallurgical process similar to stamping that utilizes a ram to force heated metal preforms into the shape of a die imprint. The process is generally very rapid, for example, a forging event can take place in less than 0.2 seconds. Forged parts for gas turbine engines (e.g., forged airfoils) may need to maintain tight dimensional controls, for example, some parts or part areas may require tolerances of ±0.003 inches (±0.076 mm). Inaccuracy, or misalignment, of the forging dies can increase variability in the final part, which can lead to low yields. Sources of variability in the forging process are difficult to detect, as limited data streams exist for informing engineering actions to improve process controls. Additionally, installation of forging dies can be time consuming, as confirming proper die alignment can be difficult.

SUMMARY

A forging assembly is disclosed herein. In accordance with various embodiments, the forging assembly may comprise a first die and a second die configured to translate toward the first die. A first sensor may be coupled to at least one of the first die or the second die. The first sensor may be configured to output a first signal correlating to a first distance between the first die and the second die.

In various embodiments, the first sensor may comprise a capacitive sensor. In various embodiments, a second sensor may be configured to output a second signal correlating to a second distance between the first die and the second die. The first distance may be measured in a first direction and the second distance may be measured in a second direction different from the first direction.

In various embodiments, a third sensor may be configured to output a third signal correlating to a third distance between the first die and the second die. The third distance may be measured in a third direction different from the first direction and the second direction.

In various embodiments, a data acquisition system may be operably coupled to the first sensor. A tangible, non-transitory memory may be configured to communicate with the data acquisition system. The tangible, non-transitory memory may have instructions stored thereon that, in response to execution by the data acquisition system, cause the data acquisition system to perform operations, comprising: receiving, by the data acquisition system, the first signal from the first sensor, and determining, by the data acquisition system, a location of the second die relative to the first die based on the first signal. In various embodiments, the instructions may cause the data acquisition system to perform operations further comprising at least one of: calculating, by the data acquisition system, a velocity of the second die; calculating, by the data acquisition system, an acceleration of the second die; determining, by the data acquisition system, an elastic deformation of the second die; or determining, by the data acquisition system, an elastic deformation of the first die.

In various embodiments, a field of view of the first sensor may be greater than or equal to the first distance as measured at a moment of contact between the second die and a workpiece located on the first die. In various embodiments, the first die may define at least one of a cavity or a protrusion. The first sensor may be located at least one of within the cavity or on the protrusion.

Also disclosed herein, in accordance with various embodiments, is a forging assembly comprising a first die and a second die configured to translate toward the first die. A first sensor may be coupled to at least one of the first die or the second die. The first sensor may be configured to output a first signal correlating to a first distance between the first die and the second die. A data acquisition system may be configured to receive the first signal.

In various embodiments, a tangible, non-transitory memory may be configured to communicate with the data acquisition system. The tangible, non-transitory memory may have instructions stored thereon that, in response to execution by the data acquisition system, cause the data acquisition system to perform operations, comprising: receiving, by the data acquisition system, the first signal from the first sensor, and determining, by the data acquisition system, a location of the second die relative to the first die based on the first signal.

In various embodiments, the instructions may cause the data acquisition system to perform operations further comprising at least one of: calculating, by the data acquisition system, a velocity of the second die; calculating, by the data acquisition system, an acceleration of the second die; determining, by the data acquisition system, an elastic deformation of the second die; or determining, by the data acquisition system, an elastic deformation of the first die.

In various embodiments, a forge press controller may be operably coupled to the data acquisition system and the second die. A tangible, non-transitory memory may be configured to communicate with the forge press controller. The tangible, non-transitory memory may have instructions stored thereon that, in response to execution by the forge press controller, cause the forge press controller to perform operations, comprising: receiving, by the forge press controller, a data output from the data acquisition system, and sending, by the forge press controller, a command signal configured to modify an operating parameter of the second die. In various embodiments, the operating parameter may comprise at least one of a velocity of the second die, an acceleration of the second die, a press power setting, or a position of the second die relative to the first die.

In various embodiments, a second sensor may be configured to output a second signal correlating to a second distance between the first die and the second die. The first distance may be measured in a first direction and the second distance may be measured in a second direction different from the first direction.

In various embodiments, a second sensor may be configured to output a second signal correlating to a second distance between the first die and the second die. The first distance may be measured in a first direction, and the second distance may be measured in the first direction. In various embodiments, the first sensor may comprise a capacitive sensor.

A method for analyzing performance of a forging assembly is also disclosed herein. In accordance with various embodiments, the method may comprise the step of coupling a sensor to at least one of a first die of the forging assembly or a second die of the forging assembly. The sensor may be configured to output a first signal correlating to a first distance between the first die and the second die. The method may further comprise the steps of disposing a workpiece on a first imprint surface of the first die, contacting the workpiece with a second imprint surface of the second die, and determining an operating parameter of the forging assembly based on the first signal.

In various embodiments, determining the operating parameter may comprise at least one of calculating a velocity of the second die, calculating an acceleration of the second die, calculating an elastic deformation of at least one of the first die or the second die, or determining a location of the second die relative to the first die.

In various embodiments, the method may further comprise comparing the operating parameter to a standard operating parameter. In various embodiments, the method may further comprise sending a command signal configured to modify the operating parameter of the forging assembly.

The foregoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1A:
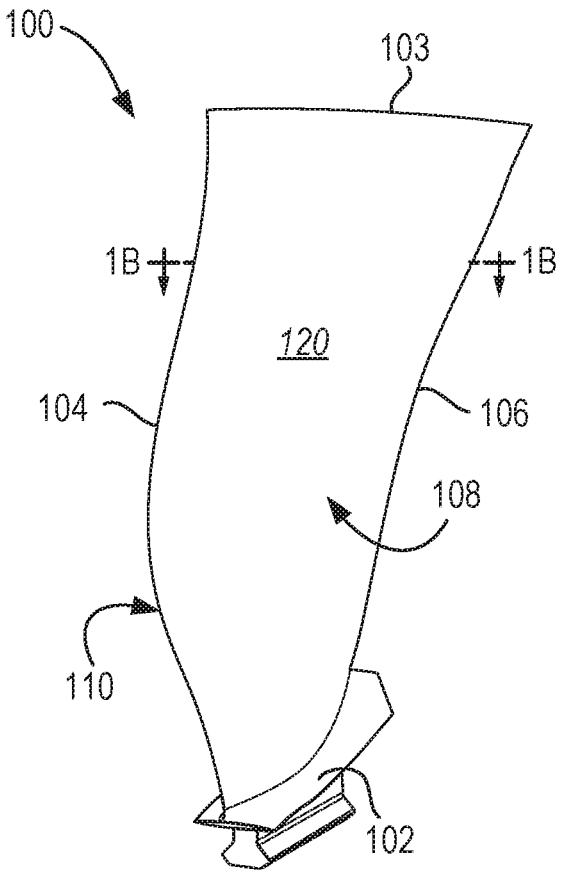
FIGS. 1A and 1B illustrate, respectively, a perspective view and a cross-sectional view of an airfoil, in accordance with various embodiments.

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation. The steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface cross hatching lines may be used throughout the figures to denote different parts but not necessarily to denote the same or different materials.

Cross hatching lines may be used throughout the figures to denote different parts but not necessarily to denote the same or different materials. Throughout the present disclosure, like reference numbers denote like elements. Accordingly, elements with like element numbering may be shown in the figures, but may not be necessarily be repeated herein for the sake of clarity.

Airfoils may be utilized in various sections of a gas turbine engine to direct, condition, and affect the flow of fluid (e.g., air and/or combustion gases) through the gas turbine engine. Current systems and methods for forming the airfoils may employ forging assemblies configured to shape the metal material of the airfoil between a pair of dies. Such dynamic systems and methods can impart variability in the shape of the airfoils. For example, elastic deformation, wear, and/or other movement of dies may alter the camber or other parameters of the airfoil geometry. Variability in the camber or in other airfoil dimensional parameters (e.g., leading edge angle, trailing edge angle, etc.) may lead to variations in the flow characteristics and flow capacity of the airfoil. Airfoil assemblies that do not meet stringent dimensional tolerance requirements may be discarded, which tends to increase material waste and cost.

Disclosed herein is a forging assembly having sensors configured to measure a distance between the two mating dies. The sensor may continuously measure die closure and alignment behavior in close proximity to an imprint surface of the die. The data output from the sensors may provide insight into the forging process, provide a baseline for understanding press variability, and/or inform decisions needed to determine final forging dimensions and/or improve part dimensional yields. The forging assembly may include a data acquisition system configured to track die closure behavior (distance vs. time) with high precision during a forging event. Forging assemblies as disclosed herein may be associated with reduced setup time, as compared to traditional forging assemblies, as the sensors can provide accurate and rapid die alignment data. Accordingly, forging assemblies having one or more die position sensor may enable the production of dimensionally accurate airfoils or other engine parts, while also reducing forge press setup time.

With reference to FIG. 1A, an airfoil 100 for a gas turbine engine is disclosed, in accordance with various embodiments. Airfoil 100 may include a hub end 102 for attaching the airfoil 100 to a disk of a rotor system. Airfoil 100 comprises a radially outer edge or tip 103 located radially outward from hub end 102. Airfoil 100 has a leading edge 104 and a trailing edge 106 opposite the leading edge. In various embodiments, airfoil 100 may include a generally concave pressure surface 108 and a generally convex suction surface 110 joined together at the respective leading edge 104 and trailing edge 106. Airfoil 100 may be curved and twisted relative to, for example, a plane extending radially from hub end 102.

Figure 1B:
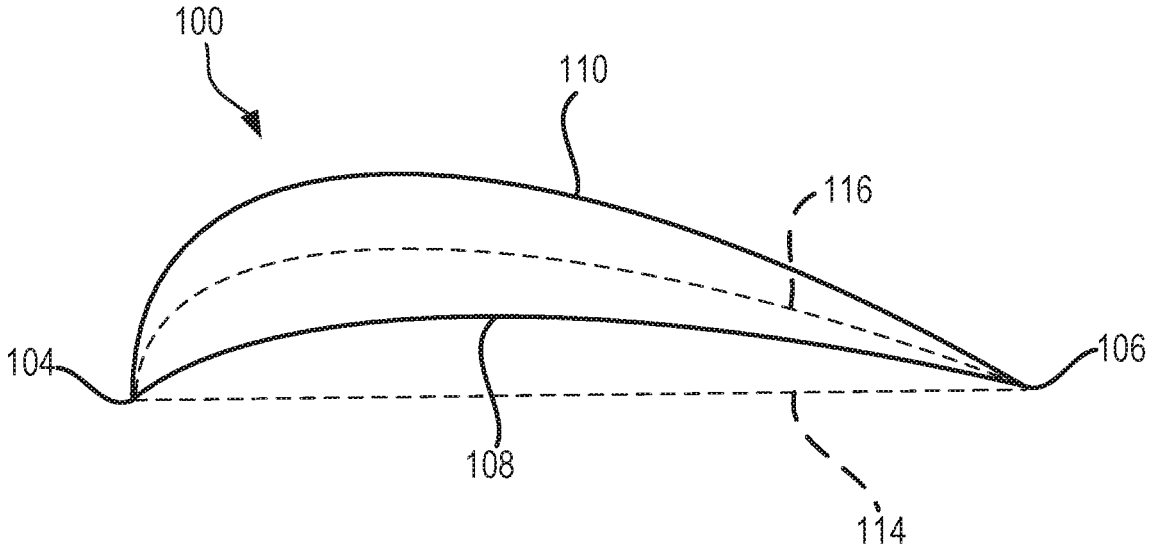

With reference to FIG. 1B, a cross-section view of airfoil 100 taken along the line 1B-1B in FIG. 1A is illustrated. Airfoil 100 comprises a chord 114. Chord 114 is an imaginary linear line extending from leading edge 104 to trailing edge 106. Airfoil 100 includes a mean camber line 116. Mean camber line 116 is an imaginary line extending from leading edge 104 to trailing edge 106 and located midway between pressure surface 108 and suction surface 110 of airfoil 100. Mean camber line 116 represents the camber of airfoil 100. Airfoil 100 further comprises a leading edge angle, a trailing edge angle, and an overall airfoil angle. The parameters of airfoil 100 (e.g., the camber, leading edge angle, trailing edge angle, overall angle, twist, attack angle, angle of incidence, etc.) are selected, or designed, according to desired airfoil operating characteristics. In this regard, airfoil 100 comprises one or more preselected airfoil parameters. For example, the camber and the overall airfoil angle of airfoil 100 may be selected to maximize flow capacity and/or produce a particular flow capacity, and the attack angle of airfoil 100 (i.e., the angle of airfoil 100 relative to the direction of airflow at the inlet of the rotor system) may be selected to improve flutter margin and/or produce a particular flutter margin.

As will be discussed in further detail below, airfoil 100 may be fabricated by forging a metallic material 120, such as a metal and/or a metal alloy, into a preselected or desired shape. Metallic material 120 may include aluminum, aluminum alloy, titanium, titanium alloy, a nickel-based alloy or nickel-based super alloy, or any other suitable metal, metal alloy, or combination thereof.

Figure 2:
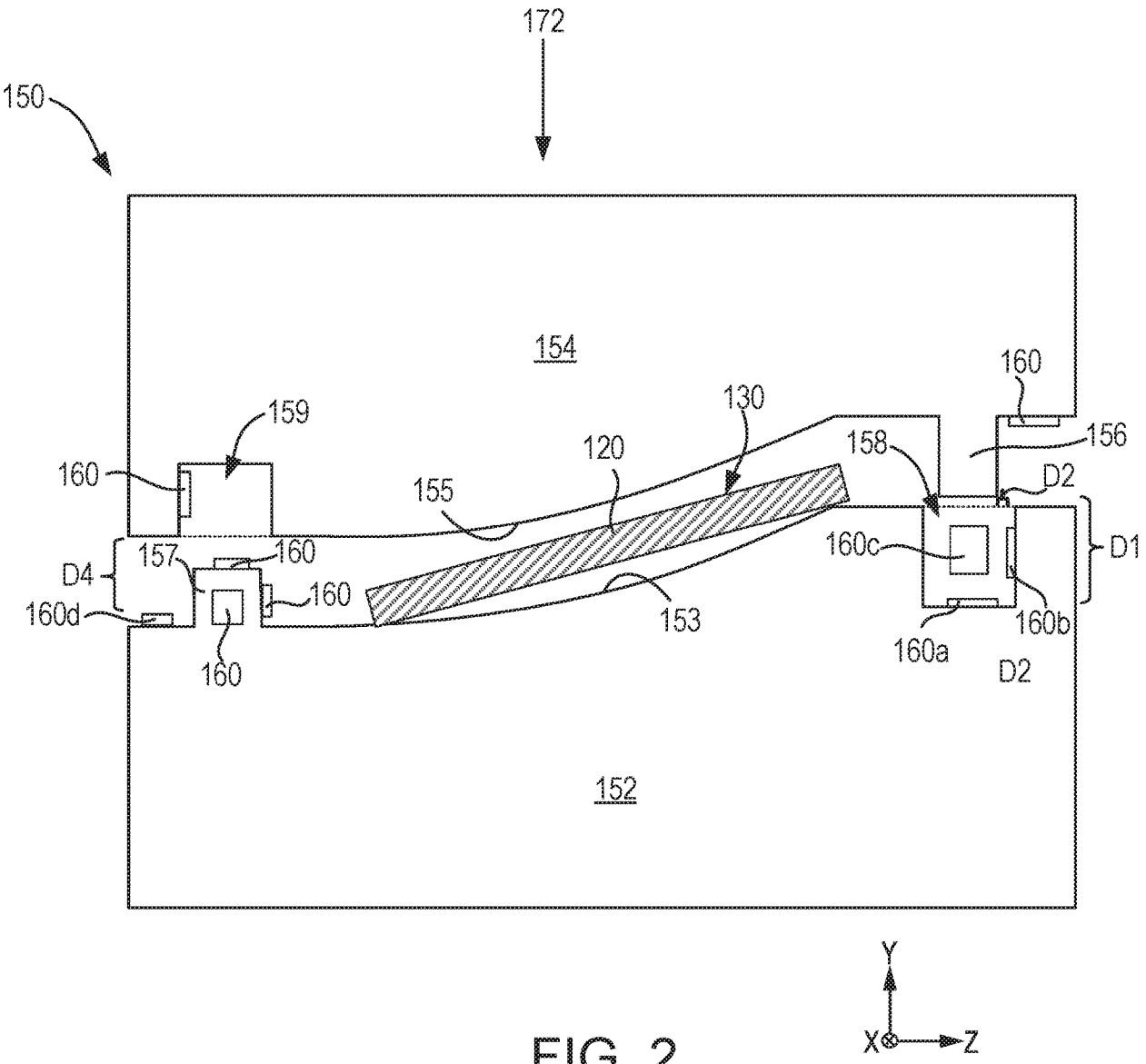
FIG. 2 illustrates a workpiece located between a top die and a bottom die of a forging assembly having applied capacitance sensors, in accordance with various embodiments.

With reference to FIG. 2, a forging assembly 150 is illustrated, in accordance with various embodiments. Forging assembly 150 includes a lower (or first) die 152 and an upper (or second) die 154. In various embodiments, forging assembly 150 may be configured to form (i.e., shape) a workpiece 130 comprised of metallic material 120 into airfoil 100 in FIG. 1A. For example, in various embodiments, workpiece 130 is placed on an imprint surface 153 of die 152. Metallic material 120 of workpiece 130 and the metallic material of dies 152 and 154 may be heated. For example, metallic material 120 may be preheated to temperatures up to, for example, 1900° F. (1038° C.) and dies 152 and 154 may be heated to temperatures of, for example, between 350° F. and 800° F. (177° C. and 427° C.). Die 154 is then translated toward to die 152 (i.e., in the direction of arrow 172). An imprint surface 155 of die 154 contacts workpiece 130. Die 154 is pressed toward die 152, thereby applying pressure to workpiece 130. The application of pressure to workpiece 130 causes heated metallic material 120 to flow and form to the shape of an imprint surfaces 153 and 155 of die 154, such that when die 154 is translated away from die 152, metallic material 120 retains and complements the shape of imprint surfaces 153 and 155. In this regard, imprint surfaces 153 and 155 may be configured to complement the desired shape (e.g., the camber, leading edge angle, trailing edge angle, overall angle, twist, attack angle, angle of incidence, etc.) of airfoil 100, with momentary reference to FIG. 1A.

It will be noted that airfoils for gas turbine engines may be provided in the variety of sizes, shapes, and geometries. Accordingly, airfoil 100 of the present disclosure is not limited to the specific geometry, size, and shape shown in the figures. Further, while forging assembly 150 is described as being employed to form airfoils, it is further contemplated and understood that forging assemblies, as disclosed herein, may be employed to form components other than airfoils.

One or more sensors 160 may be coupled to die 152 and/or die 154. Sensors 160 are configured to output a signal corresponding to a distance between die 152 and die 154. In various embodiments, sensors 160 comprise capacitance sensors capable of measuring a distance between moving metallic objects (e.g., dies 152 and 154) based on change in capacitance. In various embodiments, each sensor 160 has a field of view that allows the sensor to detect die 154 (or die 152 for sensors coupled to die 154) at, and/or just prior to, a moment of contact between die 154 and workpiece 130. Stated differently, the field of view of each sensor 160 is greater than the distance between die 152 features and die 154 features at the moment of contact between impact surface 155 and workpiece 130. Stated yet another way, features of die 154 (e.g., protrusion 156) will be within the field of view of sensors 160 attached to die 152 at the moment of contact between impact surface 155 and workpiece 130, and features of die 152 (e.g., protrusion 157) will be within the field of view of sensors 160 attached to die 154 at the moment of contact between impact surface 155 and workpiece 130.

In various embodiments, sensors 160 may be affixed to die 152 and/or die 154 via a magnetic coupling. For example, sensors 160 may be affixed to magnets which are then magnetically coupled to dies 152 and 154. Magnetically coupling the sensors to the die may allow the sensors to be moved and positioned anywhere on die 152 and/or on die 154. Sensors 160 may also be attached to die 152 and/or die 154 via tape, adhesive, mechanical attachments, fasteners, or any other suitable attachment device.

In various embodiments, a first sensor 160*a* may be configured to detect a first distance D1 between die 152 and die 154. In various embodiments, first distance D1 may be measured in a first direction, for example, in a direction along the Y-axis of the provided XYZ axes. Stated differently, first sensor 160*a* may detect a positioning of die 154 relative to die 152 in a first plane (e.g., a plane parallel to the Y-axis).

In various embodiments, a second sensor 160*b* may be configured to detect a second distance D2 between die 152 and die 154. In various embodiments, second distance D2 may be measured in a second direction, for example, in a direction along the Z-axis (i.e., orthogonal to the first direction and the Y-axis). Stated differently, second sensor 160*b* may detect a positioning of die 154 relative to die 152 in a second plane (e.g., a plane parallel to the Z-axis and orthogonal to Y-axis).

Figure 3:
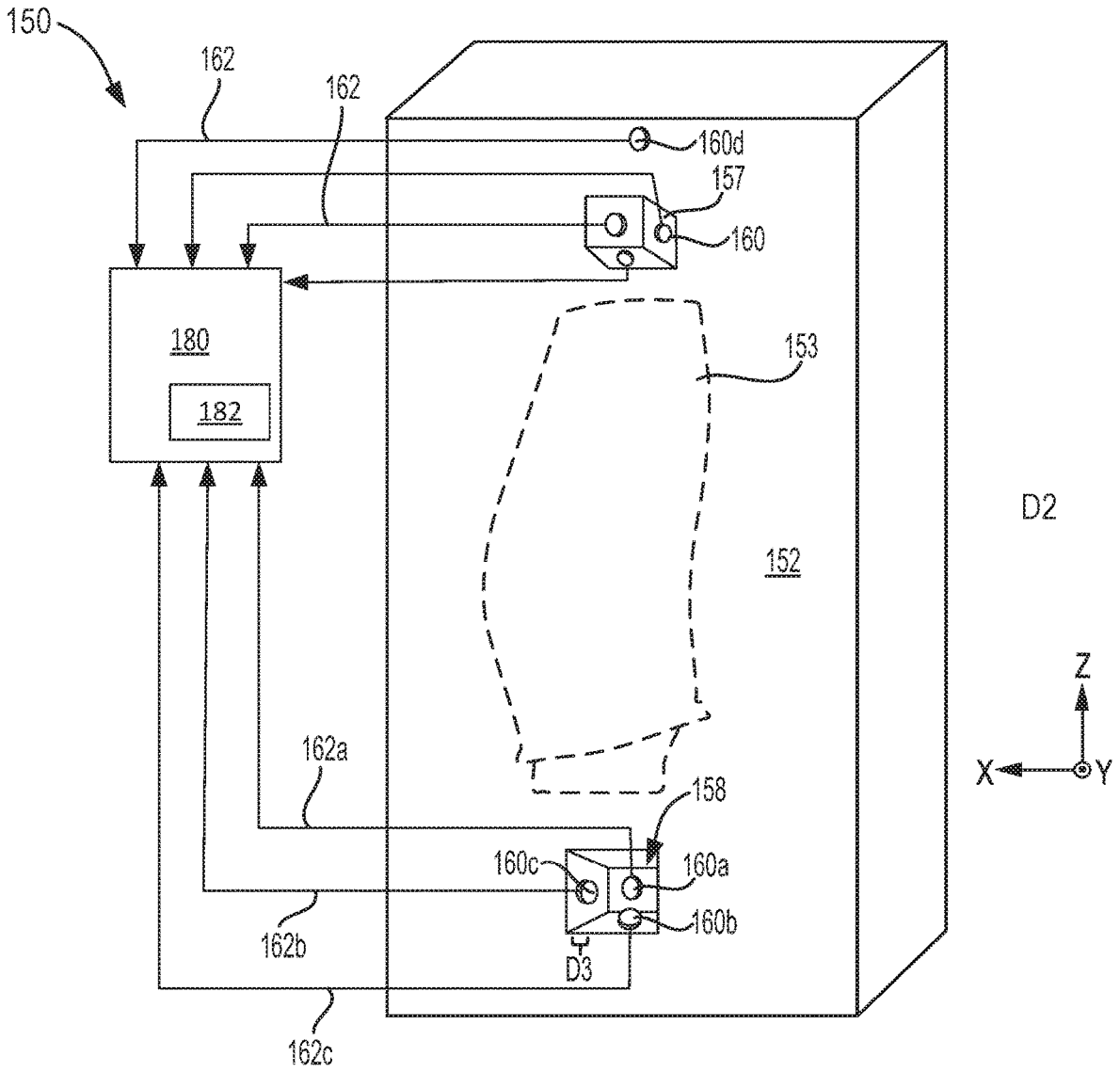
FIG. 3 illustrates a bottom die of a forging assembly having capacitance sensors, in accordance with various embodiments.

In various embodiments, a third sensor 160*c* may be configured to detect a third distance D3, with momentary combined reference to FIG. 3 and FIG. 2, between die 152 and die 154. In various embodiments, third distance D3 may be measured in a third direction, for example, in a direction along to the X-axis (i.e., orthogonal to the first direction and the second direction). Stated differently, third sensor 160*c* may detect a positioning of die 154 relative to die 152 in a third plane (e.g., a plane parallel to the X-axis and orthogonal to the Y-axis and the Z-axis). While sensors 160*a*, 160*b*, and 160*c* are illustrated as detecting the positioning of die 152 and 154 along three orthogonal axes, it is further contemplated and understood that sensors 160 of forging assembly 150 may oriented in any direction and may detect the positioning and/or movement of die 154 relative to die 152 in any plane. In various embodiments, multiple sensors 160 located at varying locations along the die may measure the distance between features of die 152 and die 154 in the same direction. For example, a first sensor 160*a* and a second sensor 160*d* may both measure distance (e.g., distance D1 and distance D4, respectively) between die 152 and die 154 in the first direction, for example, in a direction along the Y-axis.

In various embodiments, die 154 may include one or more protrusions 156, and die 152 may define one or more cavities 158 configured to receive protrusions 156. In accordance with various embodiments, one or more sensors 160 may be located within cavities 158. In various embodiments, one or more sensors 160 may be attached to protrusions 156. In various embodiments, die 152 may include one or more protrusions 157, and die 154 may define one or more cavities 159 configured to receive protrusions 157 of die 152. One or more sensors 160 may be located on protrusions 157 of die 152 and/or in cavities 159 defined by die 154.

With reference to FIG. 3, and continuing reference to FIG. 2, in various embodiments, forging assembly 150 may include a data acquisition system 180. Data acquisition system 180 may include one or more processors. Each processor can be a general purpose processor, a microprocessor, a digital signal processor (DSP), an application specific integrated circuit (ASIC), a field programmable gate array (FPGA), or other programmable logic device, discrete gate or transistor logic, discrete hardware components, or any combination thereof. System program instructions and/or data acquisition system instructions may be loaded onto a tangible, non-transitory, computer-readable medium 182 (also referred to herein as a tangible, non-transitory memory) having instructions stored thereon that, in response to execution by data acquisition system 180, cause data acquisition system 180 to perform various operations. The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in *In re Nuijten* to fall outside the scope of patentable subject matter under 35 U.S.C. § 101.

Data acquisition system 180 may be in logical and/or operable and/or electronic communication with sensors 160. In this regard, data acquisition system 180 may receive data signals 162 output from sensors. Signals 162 may be sent to data acquisition system 180 as a voltage signal, a current signal, a digital signal, or any other suitable signal, whether filtered, conditioned, or otherwise preprocessed. Signals 162 may correlate to the distance between die 152 and die 154 due to voltage-to-distance calibration of the capacitance sensors 160. For example, first sensor 160*a* may output a first signal 162*a* correlating to first distance D1, as measured in the direction of the Y-axis, between die 152 and die 154. Second sensor 160*b* may output a second signal 162*b* correlating to second distance D2, as measured in the direction of the Z-axis, between die 152 and die 154. Third sensor 160*c* may output a third signal 162*c* correlating to third distance D3, as measured in the direction of the X-axis, between die 152 and die 154. In various embodiments, sensors 160 and data acquisition system 180 may be capable of measuring and recording at high frequencies (e.g., at frequencies greater than 1 kHz), thereby allowing data acquisition system 180 to capture data from very rapid forging events (e.g., 0.2 seconds or less). The frequency of data acquisition system 180 may be adapted to the duration of the forging event. In this regard, for slower forge processes (e.g., forge processes employing a hydraulic press), data acquisition system 180 may measure and record at frequencies less than 1 kHz, and for faster forge processes (e.g., forge processes employing hammers), data acquisition system 180 may measure and record at frequencies greater than 1 kHz.

Data acquisition system 180 may use the signals 162 received from sensors 160 to determine various operating parameters of dies 152 and 154. For example, data acquisition system 180 may use signals 162 to determine a location of die 154 relative to die 152, to calculate a velocity and/or acceleration of die 154, and/or to measure an elastic deformation of die 152 and die 154 upon impact with workpiece 130. Allowing data acquisition system 180 to monitor the kinetic press behaviors, such as the closing velocity and acceleration (i.e., distance vs. time), and the alignment of dies 152 and 154 may provide high precision insight during the forging process. Utilization of in-situ process monitoring data can provide a baseline for understanding press variability and inform decisions needed to reduce part variability and improve part dimensional yield.

Figure 4:
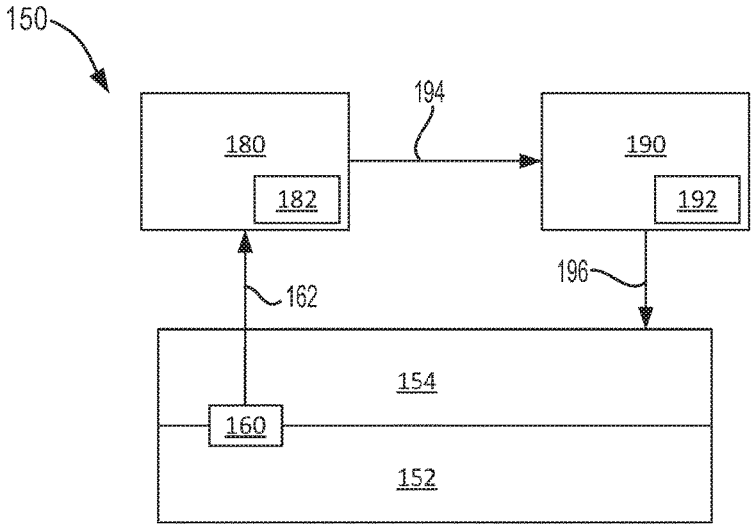
FIG. 4 illustrates a schematic diagram of a forging assembly having capacitance sensors, in accordance with various embodiments.

With reference to FIG. 4, and continuing reference to FIG. 2, in various embodiments, forging assembly 150 may include a forge press controller 190. Forge press controller 190 may include one or more processors. Each processor can be a general purpose processor, a microprocessor, a DSP, an ASIC, a FPGA, or other programmable logic device, discrete gate or transistor logic, discrete hardware components, or any combination thereof. System program instructions and/or forge press controller instructions may be loaded onto a tangible, non-transitory, computer-readable medium 192 (also referred to herein as a tangible, non-transitory memory) having instructions stored thereon that, in response to execution by forge press controller 190, cause forge press controller 190 to perform various operations. The instructions on medium 192 may be provided from process models, machine learning, or any other suitable methods.

Forge press controller 190 may be in logical and/or operable and/or electronic communication with data acquisition system 180 and die 154. In this regard, forge press controller 190 may receive an operational data signal 194 output from data acquisition system 180 and may output a command signal 196 configured to change one or more operating parameters of die 154 based on the operational data signal 194. Signals 194 and 196 may be sent as a voltage signal, a current signal, a digital signal, or any other suitable signal, whether filtered, conditioned, or otherwise preprocessed. Operational data signals 194 may correlate to one or more operating parameters of the forge press actuating and/or controlling dies 152 and 154. Forge press controller 190 may be configured to compare the operational data signals 194 to a corresponding standard operating parameter. Forge press controller 190 may determine that one or more operating parameters (e.g. closing speed, die position, press power setting, etc.) for die 154 may need to be modified for future forgings based on the comparison. In this regard, command signal 196 may be configured to modify an operating parameter of die 154.

Figure 5:
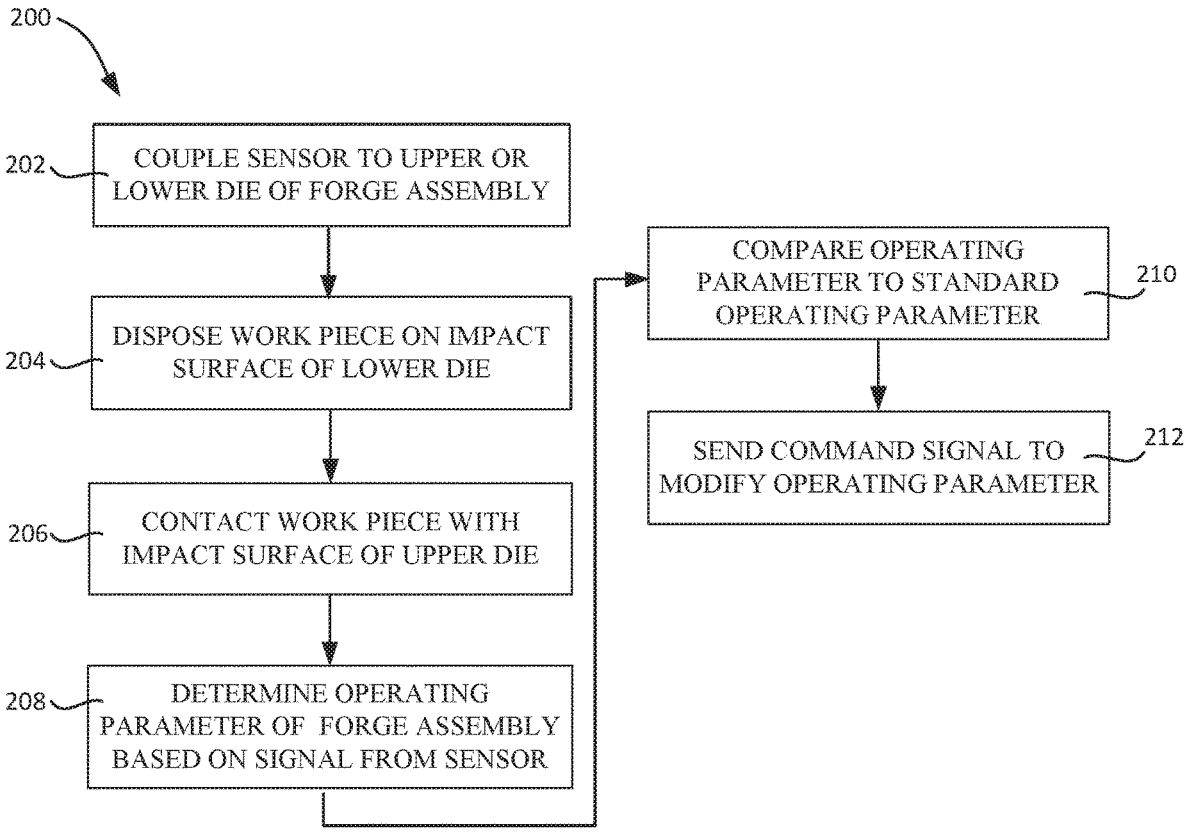
FIG. 5 illustrates a method of analyzing performance of a forging assembly, in accordance with various embodiments.

With reference to FIG. 5, a method 200 for analyzing performance of a forging assembly is illustrated, in accordance with various embodiments. In various embodiments, method 200 may comprise coupling one or more sensor(s) to a first die or a second die of the forging assembly (step 202). The sensor may be configured to output a first signal correlating to a first distance between the first die and the second die. Method 200 may further comprise disposing a workpiece on an imprint surface of the first die (step 204), contacting the workpiece with an imprint surface the second die (step 206), and determining an operating parameter of the forging assembly based on the first signal (step 208). In various embodiments, the first signal may be output to a data acquisition system configured to determine the operating parameter.

In various embodiments, method 200 may further include comparing the operating parameter to a standard operating parameter (step 210). In various embodiments, method 200 may further include sending a command signal configured modify the operating parameter in a subsequent forging operation (step 212).

In various embodiments, step 208 may include calculating a velocity of the second die or calculating an acceleration of the second die. In various embodiments, step 208 may include determining a location of the second die relative to the first die. In various embodiments, step 208 may include calculating an elastic deformation of the first die or the second die.

With combined reference to FIG. 5 and FIG. 2, in various embodiments, step 202 may include coupling first sensor 160*a* to die 152 or die 154 of forging assembly 150. First sensor 160*a* may be configured to output first signal 162*a* (FIG. 3) correlating to first distance D1 between die 152 and die 154. Step 204 may include disposing workpiece 130 on imprint surface 153 of die 152. Step 206 may include contacting workpiece 130 with imprint surface 155 of die 154. Step 208 may comprise determining an operating parameter of forging assembly 150 based on first signal 162*a* (FIG. 3). Step 210 may include comparing the operating parameter of forging assembly 150 to a standard operating parameter. The standard operating parameter may be set by modeling, machine learning, or any other suitable criteria. Step 212 may include sending command signal 196 to modify an operating parameter of die 154 in a subsequent forging operation.

Benefits, other advantages, and solutions to problems have been described herein with regard to specific embodiments. Furthermore, the connecting lines shown in the various FIGS. contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it may be within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A forging assembly, comprising:

a first die including a first imprint surface, wherein the first die defines a cavity;

a second die including a second imprint surface and configured to translate toward the first die, wherein the second die further includes a protrusion configured to be received by the cavity;

a first sensor coupled to the first die and located in the cavity, wherein the first sensor is configured to output a first signal correlating to a first distance between the first die and the second die;

a second sensor coupled to the first die and located in the cavity, wherein the second sensor is configured to output a second signal correlating to a second distance between the first die and the second die, wherein the first distance is measured in a first direction and the second distance is measured in a second direction orthogonal to the first direction;

a third sensor coupled to the first die and located in the cavity, wherein the third sensor is configured to output a third signal correlating to a third distance between the first die and the second die, wherein the third distance is measured in a third direction, the third direction being orthogonal to the first direction and to the second direction; and a magnet affixed to at least one of the first sensor, the second sensor, or the third sensor, wherein the at least one of the first sensor, the second sensor, or the third sensor is magnetically coupled to the first die via the magnet.

2. The forging assembly of claim 1, wherein the first sensor, the second sensor, and the third sensor each comprises a capacitive sensor.

3. The forging assembly of claim 1, further comprising:

a data acquisition system operably coupled to the first sensor; and a tangible, non-transitory memory configured to communicate with the data acquisition system, the tangible, non-transitory memory having instructions stored thereon that, in response to execution by the data acquisition system, cause the data acquisition system to perform operations, comprising:

receiving, by the data acquisition system, the first signal from the first sensor, the second signal from the second sensor, and the third signal from the third sensor; and determining, by the data acquisition system, a location of the second die relative to the first die based on the first signal, the second signal, and the third signal.

4. The forging assembly of claim 3, wherein the instructions cause the data acquisition system to perform operations further comprising at least one of:

calculating, by the data acquisition system, a velocity of the second die based on the first signal output by the first sensor during a contacting of a workpiece by the second die; or calculating, by the data acquisition system, an acceleration of the second die based on the first signal output by the first sensor during a contacting of a workpiece by the second die.

5. The forging assembly of claim 1, wherein a field of view of the first sensor is greater than the first distance as measured at a moment of contact between the second die and a workpiece located on the first die, and wherein the first sensor, the second sensor, and the third sensor each operate at frequencies of greater than 1.0 kilohertz.

6. The forging assembly of claim 3, wherein the instructions cause the data acquisition system to perform operations further comprising at least one of:

determining, by the data acquisition system, an elastic deformation of the second die; or determining, by the data acquisition system, an elastic deformation of the first die.

7. A forging assembly, comprising:

a first die including a first imprint surface, wherein the first die defines a cavity;

a second die configured to translate toward the first die and including a second imprint surface, wherein the second dies includes a protrusion configured to be received in the cavity;

a first sensor coupled to at least one of the cavity of the first die or the protrusion of the second die, wherein the first sensor is configured to output a first signal correlating to a first distance between the first die and the second die;

a second sensor coupled to at least one of the cavity of the first die or the protrusion of the second die, wherein the second sensor is configured to output a second signal correlating to a second distance between the first die and the second die, wherein the first distance is measured in a first direction and the second distance is measured in a second direction orthogonal to the first direction;

a data acquisition system configured to receive the first signal and the second signal; and a first tangible, non-transitory memory configured to communicate with the data acquisition system, the first tangible, non-transitory memory having instructions stored thereon that, in response to execution by the data acquisition system, cause the data acquisition system to perform operations, comprising:

receiving, by the data acquisition system, the first signal from the first sensor, the first signal being received during contact between the second imprint surface and a workpiece located on the first imprint surface; and calculating, by the data acquisition system, at least one of a velocity of the second die or an acceleration of the second die using the first signal received during contact between the second imprint surface and the workpiece.

8. The forging assembly of claim 7, further comprising a third sensor coupled to at least one of the first die or the second die, wherein the third sensor is configured to output a third signal correlating to a third distance between the first die and the second die, wherein the third distance is measured in a third direction, the third direction being orthogonal to the first direction and to the second direction, wherein the data acquisition system is configured to receive the third signal from the third sensor.

9. The forging assembly of claim 8, wherein the instructions cause the data acquisition system to perform operations further comprising at least one of:

determining, by the data acquisition system, an elastic deformation of the second die; or determining, by the data acquisition system, an elastic deformation of the first die.

10. The forging assembly of claim 7, further comprising:

a forge press controller operably coupled to the data acquisition system and the second die; and a second tangible, non-transitory memory configured to communicate with the forge press controller, the second tangible, non-transitory memory having instructions stored thereon that, in response to execution by the forge press controller, cause the forge press controller to perform operations, comprising:

receiving, by the forge press controller, a data output from the data acquisition system; and sending, by the forge press controller, a command signal configured to modify an operating parameter of the second die.

11. The forging assembly of claim 10, wherein the operating parameter comprises at least one of the velocity of the second die, the acceleration of the second die, a press power setting, or a position of the second die relative to the first die.

12. The forging assembly of claim 7, wherein the first sensor comprises a capacitive sensor.

13. A method for analyzing performance of a forging assembly, comprising:

coupling a first sensor to at least one of a first die of the forging assembly or a second die of the forging assembly, wherein the first die or the second die defines a cavity and the other of the first die and the second die includes a protrusion configured to be received in the cavity, and wherein the first sensor is at least one of located in the cavity or coupled to the protrusion, the first sensor being configured to output a first signal correlating to a first distance between the first die and the second die;

coupling a second sensor to at least one of the first die or the second die, wherein the second sensor is at least one of located in the cavity or coupled to the protrusion, the second sensor being configured to output a second signal correlating to a second distance between the first die and the second die, wherein the first distance is measured in a first direction and the second distance is measured in a second direction orthogonal to the first direction;

disposing a workpiece on a first imprint surface of the first die;

contacting the workpiece with a second imprint surface of the second die; and after contacting the workpiece, determining an operating parameter of the forging assembly based on at least one of the first signal or the second signal, wherein determining the operating parameter comprises at least one of calculating a velocity of the second die or calculating an acceleration of the second die based on the at least one of the first signal or the second signal output by the respective first sensor or second sensor during the contacting of the workpiece.

14. The method of claim 13, wherein determining the operating parameter further comprises at least one of calculating an elastic deformation of at least one of the first die or the second die, or determining a location of the second die relative to the first die.

15. The method of claim 13, further comprising:

determining a distance between the first die and the second die based on at least one of the first signal or the second signal, wherein the distance is determined after the second die contacts the workpiece; and comparing the distance to a baseline distance; and adjusting at least one of a closing speed or a press power setting of the forging assembly if a difference between the distance and the baseline distance is greater than a threshold difference.

16. The method of claim 15, further comprising sending a command signal configured to modify the operating parameter of the forging assembly.

* * * * *